US005171085A

United States Patent [19]

Jaksich

[11] Patent Number: 5,171,085

[45] Date of Patent: Dec. 15, 1992

[54] RECESSED LIGHTING FIXTURE WITH END CAPS INCORPORATING DIFFUSER MOUNT

[75] Inventor: Milenko Jaksich, Camarillo, Calif.

[73] Assignee: Thin-Lite Corporation, Camarillo, Calif.

[21] Appl. No.: 736,013

[22] Filed: Jul. 25, 1991

[51] Int. Cl.[5] ..... F21V 17/00

[52] U.S. Cl. ..... 362/147; 362/223; 362/260; 362/311

[58] Field of Search ..... 362/147, 148, 217, 223, 362/260, 311, 374, 433, 364

[56] References Cited

U.S. PATENT DOCUMENTS

| | | | |
|---|---|---|---|
| 2,694,775 | 11/1954 | Florenec . | |
| 2,864,939 | 12/1958 | Bodian . | |
| 2,985,090 | 5/1961 | Quin . | |
| 3,010,378 | 11/1961 | Geocaris . | |
| 3,159,352 | 12/1964 | Wakefield . | |
| 3,275,822 | 9/1966 | Vince et al. | 362/223 |
| 3,947,678 | 3/1976 | Tang . | |
| 4,338,653 | 7/1982 | Marrers . | |
| 4,342,072 | 7/1982 | Guritz . | |
| 4,573,111 | 2/1986 | Herst et al. | 362/223 |
| 4,580,200 | 4/1986 | Hess . | |
| 4,625,267 | 11/1986 | Mikalonis . | |
| 4,630,181 | 12/1986 | Fain . | |
| 4,667,275 | 5/1987 | Herst et al. | 362/223 |
| 4,698,733 | 10/1987 | Griffin . | |
| 4,860,180 | 8/1989 | Degelmann . | |
| 4,891,737 | 1/1990 | Szymanck | 362/223 |

*Primary Examiner*—Richard R. Cole

*Attorney, Agent, or Firm*—Fulwider, Patton, Lee & Utecht

[57] ABSTRACT

The lighting fixture recessible into an opening formed in a ceiling and including a housing defining a recessible pan mount for mounting electrical lamp sockets. Such housing then projects downwardly through the opening and mounts on the opposite ends thereof respective end caps. The end caps project downwardly from the opening and flare laterally outwardly to the opposed sides to form wings which mount stub pins in longitudinally axial alignment. Such pins are adapted for being engaged by grooves formed in the opposite lateral sides of a channel shaped diffuser such that the diffuser may be detachably mounted from the end caps.

9 Claims, 3 Drawing Sheets

FIG. 7
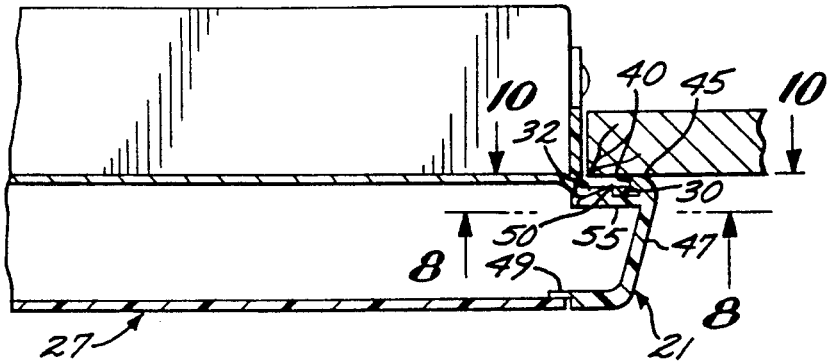
FIG. 8
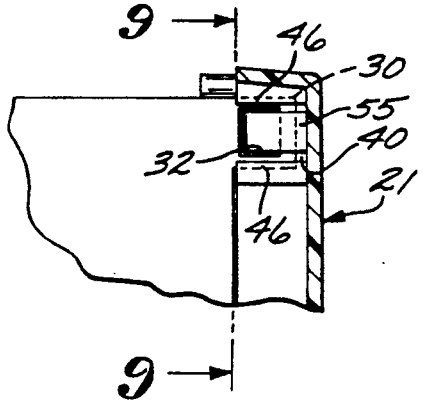
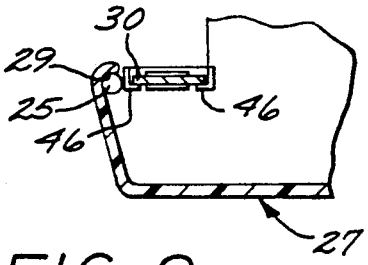
FIG. 9
FIG. 10
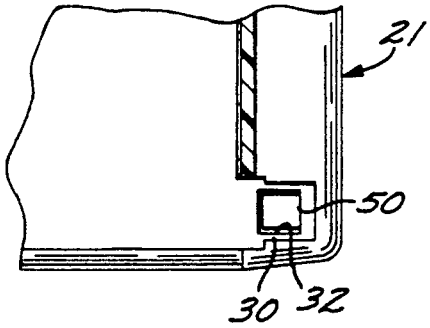
FIG. 11
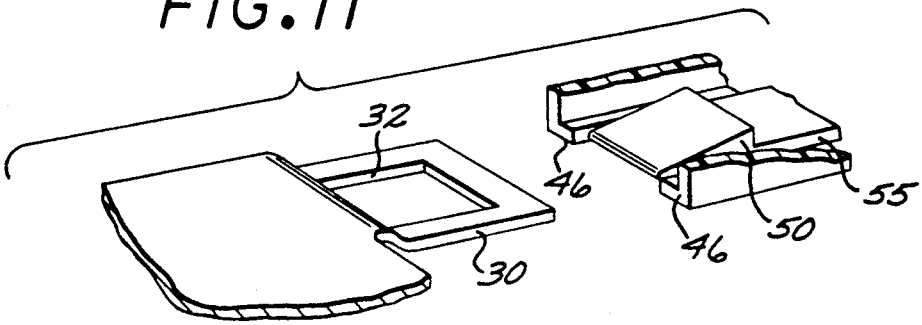

RECESSED LIGHTING FIXTURE WITH END CAPS INCORPORATING DIFFUSER MOUNT

BACKGROUND OF THE INVENTION

1. Field of the Invention

The present invention relates generally to lighting fixtures and more particularly to lighting fixtures that are recessible into an opening formed in a ceiling.

2. Description of the Prior Art

Elongated lighting fixtures for receipt of fluorescent tubes have become quite popular. It has long been the practice of manufacturers to construct housings for such fixtures by extruding aluminum channel shapes having a thickness on the order of 0.0078 inches. The extruded channel shapes are typically cut to length, anodized, holes drilled and end caps secured by pop rivets or screws.

More recently, fixtures of this type have gained popularity in the recreational vehicle market. In this market, weight and economy become a major factor. Thus, many efforts have been made to minimize the weight of such fixtures and to minimize the number of components required for assembly thereof as well as the cost of manufacturing such components. Also, in the recreational vehicle market, lighting fixtures which are, to a major extent, recessible into the ceiling or side wall of a recreational vehicle, leaving only an opaque or translucent diffuser element and a border portion area, exposed to the viewer have also gained popularity. One such lighting fixture incorporates a channel shaped extruded aluminum pan defining a housing which has downwardly projecting opposed sides which, at their free extremities, are formed with turned back confronting flanges defining confronting grooves for receipt of the opposed terminal edges of a channel shaped diffuser lens. End caps are then riveted or secured to the opposite ends of the housing. A device of this type is shown in U.S. Pat. No. 4,698,733 to Griffin and assigned to the assignee of the instant application.

Such devices, while enjoying substantial success commercially, suffer the shortcoming that the extruded housing consumes considerable metal, typically has a relatively high profile requiring substantial clearance for recessing, adds substantially to the weight of any vehicle in which it is installed and must be anodized after extrusion.

Other lighting fixture designs for receipt of elongated tubes have formed with channel shaped housings of relatively complex cross sectional construction and include opposed mounting flanges for receipt of the terminal edges of the flexible walls of a diffuser. A device of this type is shown in U.S. Pat. No. 3,159,352. Such devices are relatively expensive to form, require a fairly substantial amount of material to form screw tracks for receipt of end cap mounting screws and mounting flanges of sufficient structural rigidity to form the grooves for receipt of the opposed sides of the diffuser. Such housings also often are of such depth or thickness as to be somewhat limited to installations where substantial clearance is afforded behind the ceiling or wall in which it is to be mounted.

Elongated mounting fixtures have been proposed which include channel shaped housings onto which channel shaped diffusers are mounted. End caps are then received over the opposed ends thereof of such housing and diffuser. A device of this type is shown in U.S. Pat. No. 2,694,775 to Florence. Such lighting fixtures, while providing adequate mounting and lighting capabilities, are relatively expensive to manufacture since mounting of the diffuser incorporates relatively sophisticated construction thereby adding to the expense of manufacture. Thus, there exists a need for a recessed fluorescent tube lighting fixture which is of relatively simple and straightforward construction, provides economical to manufacture and which will provide for an aesthetically pleasing appearance and for reliable mounting of a diffuser lens.

SUMMARY OF THE INVENTION

The recessed lighting fixture of the present invention is characterized by a generally channel shaped housing defining a pan which may be recessed into an opening in the ceiling and formed with opposing side walls which project downwardly and turn laterally outwardly to form mounting flanges adapted to mount against the surrounding ceiling surface. End caps are provided for attachment to the opposite ends of the housing and include downwardly and laterally outwardly projecting wings which mount stub pins that are axially aligned for releasible nesting thereonto of outwardly opening grooves formed in the opposite sides of the side walls of a diffuser lens.

Other objects and features of the invention will become apparent from consideration of the following description taken in conjunction with the accompany drawing.

BRIEF DESCRIPTION OF THE DRAWINGS

FIG. 7 is a partial longitudinal vertical sectional view, in enlarged scale, taken along the line 7—7 of FIG. 6;

FIG. 8 is a partial horizontal sectional view taken along the line 8—8 of FIG. 7;

FIG. 9 is a partial vertical sectional view taken along the line 9—9 of FIG. 8;

FIG. 10 is a horizontal sectional view taken along the line 10—10 in FIG. 7;

FIG. 11 is a broken, exploded perspective view, in enlarged scale, of the connector tab construction incorporated in the lighting fixture shown in FIG. 7.

DESCRIPTION OF THE PREFERRED EMBODIMENT

Figure 1:
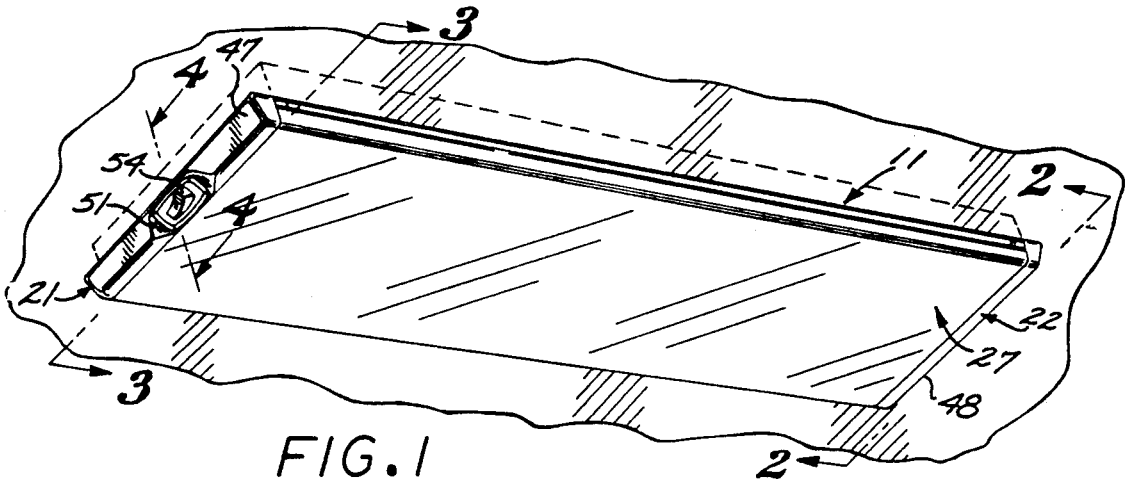
FIG. 1 is a perspective view of a lighting fixture embodying the present invention.

The lighting fixture of the present invention includes, generally, a box shaped sheet metal housing 11 formed with a recessed pan 13 having downwardly projecting side walls 15 (FIG. 3) which turn outwardly at their bottom marginal edges to define horizontal mounting flanges 19. Mounted on the opposite ends of the housing are formed end caps, generally designated 21 and 22, which project downwardly and flare laterally outwardly to form respective opposed side wings 23 and 24 which mount at a outer extremity thereof respective longitudinal stub pins 25. A channel shaped diffuser, generally designated 27, is formed along its opposite sides with outwardly opening grooves 31 (FIG. 3) for engagement on the pins 25 to lock such diffuser in covering relation under the housing.

In the construction of lighting fixtures, sheet metal has proven a relatively inexpensive material and, of course, the less complicated the contour thereof, the more economical the manufacture thereof becomes. It is an advantage of the present invention that the pan 13 and end caps 21 and 22 are of relatively straightforward construction such that the expense of manufacture is limited.

Figure 3:
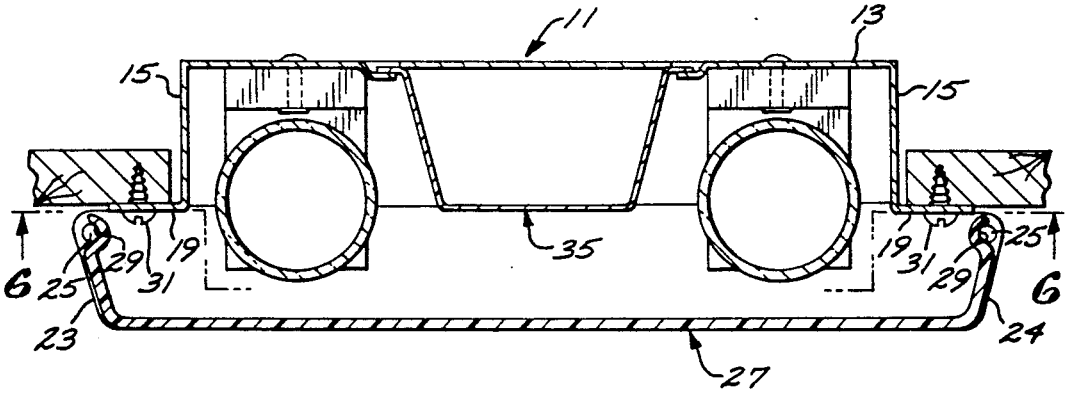
FIG. 3 is a transverse sectional view, in enlarged scale, taken along the line 3—3 of FIG. 1.
Figure 4:
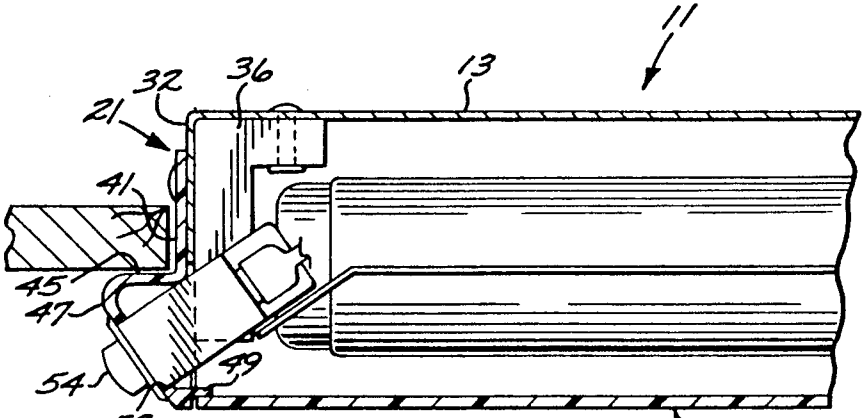
FIG. 4 is a partial sectional view, in enlarged scale, taken along the line 4—4 of FIG. 1.
Figure 6:
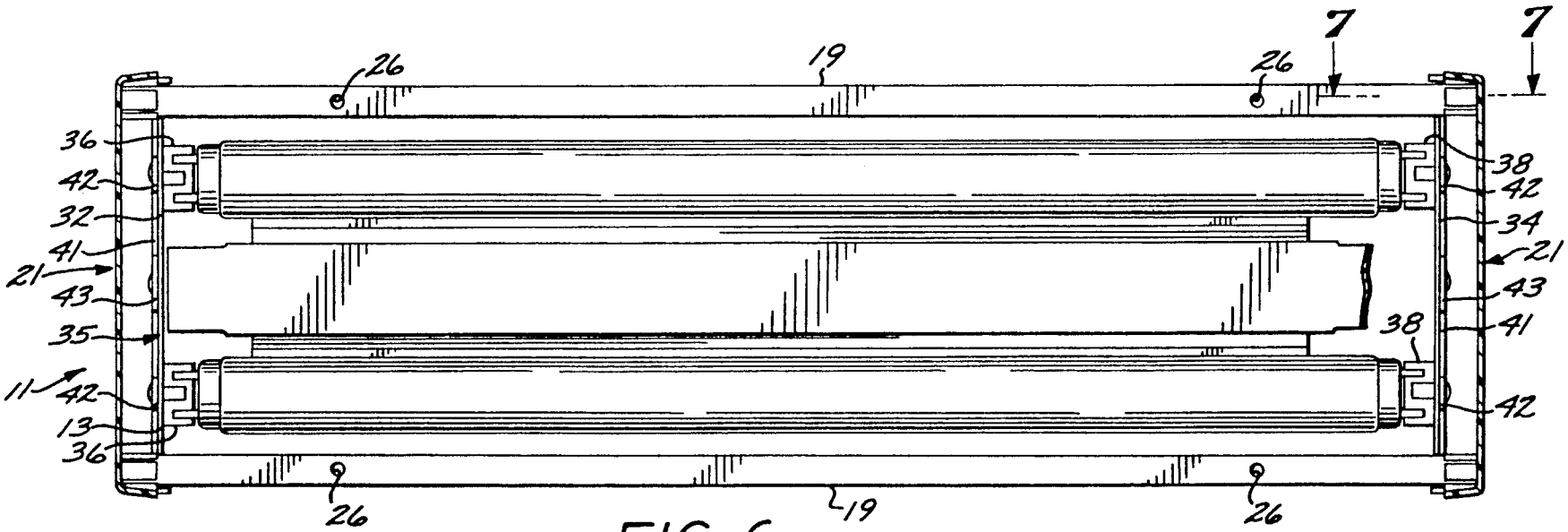
FIG. 6 is a sectional view, in reduced scale, taken along the line 6—6 of FIG. 3.

The pan 13 is of generally rectangular construction and is formed with a top wall and the downwardly projecting opposed side walls 15 which are turned outwardly to form the mounting flanges 19 (FIG. 3). The marginal ends of the pan 13 are bent downwardly to form respective end walls 32 and 34 (FIG. 4). It will be appreciated that this basic construction is relatively straightforward and inexpensive to fabricate. The mounting flanges 19 are formed along their length with spaced mounting bores 26 (FIG. 6) for receipt of mounting screws 31. Such flanges terminate at their ends in respective longitudinally projecting resilient locking tabs 30 (FIGS. 7, 10 and 11) formed by respective frames defining respective rectangular windows 32. The purpose of such tabs will be set forth in greater detail herebelow.

As set forth in U.S. Pat. No. 4,698,733 assigned to the assignee of the subject application, a relatively inexpensive channel shaped way cover, generally designated 35, is mounted on the underside of the top wall for receipt therein of the various electrical components typically incorporated in such a lighting fixture.

The end sockets 36 and 38 are L-shaped in cross section (FIGS. 4 and 5) to form respective orthogonal legs. The top leg of each socket is formed with an open ended slot for receipt of a mounting rivet securing each such socket to the top wall 13.

Figure 2:
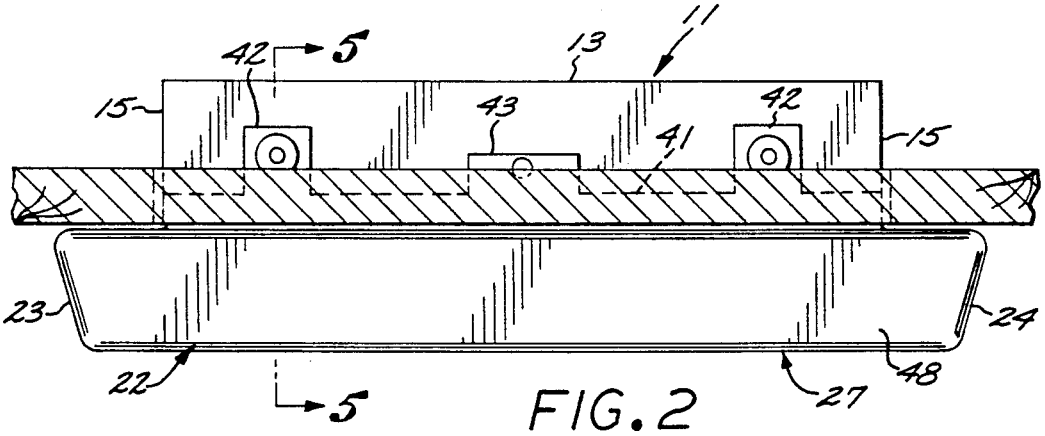
FIG. 2 is a end view, in enlarged scale, taken along the line 2—2 of FIG. 1.

The end caps 21 and 22 are conveniently molded from hard plastic and, for example, include planar mounting strips 41 which, in the preferred embodiment, overlie and are riveted to the respective end walls 32 and 34 (FIG. 4). The end caps 21 and 22 then project downwardly and laterally outwardly to form an underhang defining the side wings 23 and 24 (FIG. 3). The mounting strips 41 are formed with a pair of laterally spaced apart upstanding mounting tabs 42 aligned with the respective sockets 36 and 38 (FIG. 2). A central tab 43 is formed therebetween such tabs 42 and is also riveted to the end wall.

Figure 5:
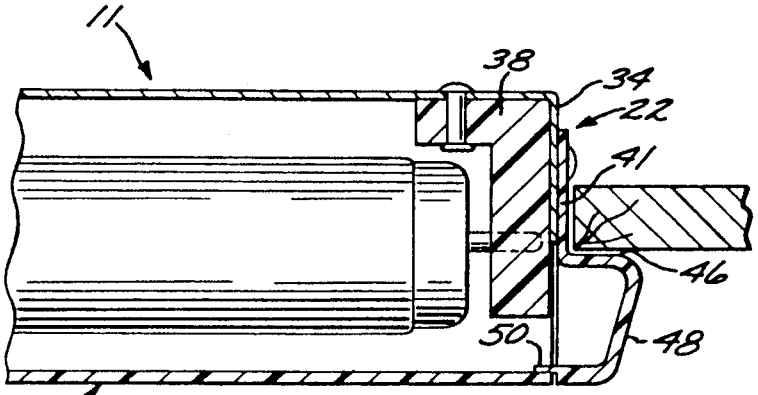
FIG. 5 is a partial longitudinal sectional view taken along the line 5—5 of FIG. 2.

The end caps 21 and 22 are formed with respective transverse channel shaped rails. To form such rails the respective mounting strips 41 project vertically downwardly and turn longitudinally outwardly at the ceiling plane as shown in FIG. 5 to form respective horizontal runs 45 and 46 and then wrap around to turn downwardly and angle inwardly to form respective inwardly inclined end walls 47 and 48 which turn inwardly at their lower extremities to form bottom walls disposed at the opposite ends of the bottom wall of the diffuser 27. Referring to FIGS. 4 and 5, formed at the confronting edges of such end caps are respective inwardly projecting transverse lips 49 and 50 received over the marginal ends of the bottom wall of such diffuser.

Referring to FIGS. 7, 10 and 11, the horizontal top walls 45 and 46 are formed above the respective wings with open ended confronting blind slots 40 (FIGS. 10 and 11) configured for sliding receipt of tabs 30. Formed integral with the end caps 21 and 22 beneath the respective slots 40 are horizontally spaced apart lips defining tracks (FIG. 11) for sliding receipt thereon of the respective tabs 30. Also formed integrally with the respective end caps are respective resilient cantileverally mounted tongues 55 disposed between the respective pairs of tracks 46 and formed at their free extremities with respective ratchet teeth 50 configured for snap receipt in the respective windows 32.

Referring to FIGS. 1 and 4, the inclined wall 47 at the left hand end is formed centrally with a depression 51 having an opening 52 therein. Snap mounted in such opening is a toggle type control switch 54 connected in electrical circuit with the sockets 36 and 38.

Mounted at the laterally outer extremities of the wings 23 and 24 are the respective stub pins 25 (FIG. 3), it being appreciated that the stub pins on the opposite ends of the fixture are in axial alignment one another.

The diffuser 27 may be of a molded plastic such as polyacrylic resin as, for instance, "Plexiglass". The diffuser may be made translucent either by of opaque powders in the plastic composition or possibly by etching one or both sides thereof. In the preferred the underside of the diffuser is formed with ribbing (not shown) to enhance the optical characteristics thereof.

In operation it will be appreciated that the lighting fixture of the present invention is of relatively inexpensive construction and that the housing may be stamped from a continuous strip or coil of pre-painted 0.038 inch thick sheet metal. In this manner the holes 20 and 38 and cut outs for the covers may be stamped in one operation, and the housing strip then formed and sheared. The end caps 21 and 22 may be conveniently constructed from molded plastic to the configuration shown in FIGS. 4 and 5. The stub pins 25, rails 46 and tongue 55 may conveniently be formed integrally therewith.

In assembly, the fixture may be pre-wired and the switch 54 snapped into position in the end cap opening 52. The sockets 36 and 38 may be positioned in the respective corners formed between the respective end walls 32 and 3 and the top wall 13 and riveted in position. It will be appreciated that in positioning the end caps, the tabs 30 will be received slidably on the respective tracks 46 to deflect the free ends of the tongue 55 to register the respective windows 32 downwardly over the respective snap teeth 50 to thus lock the side walls 15 and end caps 21 and 22 together.

When the lighting fixture is then to be recessed in an opening formed in the ceiling panel, the opening may be cut in a shape to complement the configuration of the pan 13 and such pan placed in position with the mounting flanges 19 overlying the marginal edges of the opening. The mounting screws 31 may then be inserted. The diffuser 27 may then be quickly installed by merely hooking the opposite ends of one groove 29 on one side of the diffuser on one pair of stub pins 25, nesting the opposite ends thereof on the respective lips 49 and 50, and flexing the opposite side of the diffuser laterally inwardly to hook the ends of the opposite groove 31 on the other pair of the stub pins 25.

With the construction described, the height to which the housing projects above the ceiling panel is relatively limited thus minimizing the clearance space above such ceiling required for recess mounting thereof. This feature can be particularly important with modern day mobile home construction when the ceiling or wall in which the light is to be recessed is spaced relatively close to the exterior shell of the vehicle. From the foregoing it will be appreciated that the recessed lighting fixture of the present invention is economical to manufacture and provides an aesthetic and sturdy construction for mounting fluorescent lighting tubes therein.

Various modifications and changes may be made with regard to the foregoing detailed description without departing from the spirit of the invention.

What is claimed is:

1. A recessed lighting fixture for insertion upwardly through a ceiling plane defined by a ceiling surface and into an opening in such ceiling, said fixture comprising;

a sheet metal housing formed to define a recessed pan to be recessed in such ceiling opening, said pan including a top wall configured on its opposite side with downwardly projecting side walls to project through said opening and then turned outwardly to form horizontal mounting flanges to overlie the marginal edges of such ceiling, said pan further being configured at its opposite ends with downturned end walls;

formed end caps mounted on said end walls, each including a mounting strip overlying a respective said end wall and then projecting downwardly and laterally outwardly to form laterally projecting wings projecting laterally outwardly beyond said mounting flanges;

fastening means fastening said end caps to said pan;

pairs of mounting pins mounted on respective said wings with pins of each pair being in axial alignment; and a channel shaped diffuser formed with a bottom wall and opposed flexible side walls projecting upwardly to be formed at their upper margins with outwardly opening grooves for engagement on said pins to thereby hold said diffuser in covering relation over said housing.

2. A recessed lighting fixture according to claim 1 wherein:

said end caps are formed with respective walls which project longitudinally outwardly from respective said mounting strips along said ceiling plane and to then turn downwardly to angle downwardly and inwardly to terminate at respective lower ends in edges abutting ends of the diffuser bottom wall.

3. A recessed lighting fixture according to claim 1 wherein:

said housing is formed with mounting flanges which project longitudinally beyond said end walls to form locking tabs; and said end caps are formed with peripheral walls each extending about a periphery of a respective said wing, the peripheral walls being formed at a top of said wings with longitudinally inwardly opening locking slots configured for slidable receipt of said tabs to secure said mounting flanges in position relative to said end caps.

4. A recessed lighting fixture as set forth in claim 3 wherein:

said locking tabs are formed with respective openings; and said end caps are formed with respective tongues including locking teeth positioned in respective said slots to register with respective said openings, to snap thereover and lock respective said end caps in position.

5. A recessed lighting fixture as set forth in claim 4 wherein:

said tongues are in the form of cantileverally mounted resilient strips configured to position respective said teeth for engagement by respective said locking tabs as they are moved into position n the respective slots to be displaced to one side for passage of the respective openings into engagement with the respective teeth.

6. A recessed lighting fixture as set forth in claim 3 wherein:

respective said end caps are formed with respective pairs of confronting tracks disposed adjacent said locking slots to cooperate in forming a passage for slidable receipt of said locking tabs.

7. A recessed lighting fixture as set forth in claim 1 wherein:

said end caps are formed with laterally projecting rails which are configured to be channel shaped in longitudinal cross section and are formed to project longitudinally outwardly from respective said mounting strips, turn downwardly to form a generally downwardly extending wall and then turn inwardly to terminate in respective edges, and being further formed at said edges with longitudinally projecting, laterally extending lips configured to receive thereon a top surface of marginal edges of said bottom wall of said diffuser, said lips and mounting pins being configured and arranged to cooperate in maintaining said diffuser locked in position in said caps.

8. A recessed lighting fixture according to claim 7 wherein:

said end caps are formed with respective diffuser support lips spaced below a plane of said mounting flanges and configured to engage over opposite marginal edges of said bottom wall of said diffuser.

9. A recessed lighting fixture for mounting in a recess opening in a ceiling and to project downwardly from a mounting plane defined by a ceiling surface and comprising:

a housing including an pan recessed upwardly through said opening and being formed with oppositely disposed end walls;

end caps mounted on said end walls and including respective mounting strips overlying respective said end walls and then projecting downwardly and flared laterally outwardly to form oppositely projecting wings;

two pair of diffuser support pins, the pins of each pair being mounted on the oppose wings of respective said end caps and being disposed in axial alignment; and a diffuser disposed in underlying relation on said housing and being formed with a bottom wall and a pair of oppositely disposed upwardly and outwardly angled flexible side walls, said side walls being formed at their free extremities with laterally outwardly opening grooves defining hooks for engagement of said pins such that said side walls may be deflected inwardly to align said hook with said pins and then released to engage the respective hooks with respective said pins.

* * * * *

UNITED STATES PATENT AND TRADEMARK OFFICE

CERTIFICATE OF CORRECTION

PATENT NO. : 5,171,085

DATED : December 15, 1992

INVENTOR(S) : Milenko Jaksich

It is certified that error appears in the above-identified patent and that said Letters Patent is hereby corrected as shown below:

Col. 4, line 25, after by, insert --incorporation--;

col. 4, line 27, after preferred, insert --construction,--;

col. 4, line 28, after with, insert --longitudinal--;

col. 4, line 32, after housing, insert --11--;

col. 4, line 46, delete [3], insert --34--.

Col. 6:

Claim 5, line 6, delete [n], insert --in--;

Claim 9, line 5, delete [an], insert --a--.

Signed and Sealed this

Ninth Day of November, 1993

Bruce Lehman

*Attest:*

BRUCE LEHMAN

*Attesting Officer*

*Commissioner of Patents and Trademarks*